United States Patent [19]

Ueno et al.

[11] 4,075,041

[45] Feb. 21, 1978

[54] COMBINED MECHANICAL AND THERMAL PROCESSING METHOD FOR PRODUCTION OF SEAMLESS STEEL PIPE

[75] Inventors: Masakatsu Ueno; Osamu Kato, both of Kitakyushu; Nobuyuki Kawauchi, Shiki; Kametaro Itoh, Kitakyushu, all of Japan

[73] Assignee: Nippon Steel Corporation, Tokyo, Japan

[21] Appl. No.: 734,369

[22] Filed: Oct. 20, 1976

[30] Foreign Application Priority Data

June 14, 1976 Japan ..... 51-69613

[51] Int. Cl.[2] ..... C21D 9/08

[52] U.S. Cl. ..... 148/12.4

[58] Field of Search ..... 148/12.4, 143

[56] References Cited

U.S. PATENT DOCUMENTS

| | | | |
|---|---|---|---|
| 1,450,699 | 4/1923 | Morse et al. | 148/12.4 |
| 3,979,231 | 9/1976 | Gondo et al. | 148/12.4 |

*Primary Examiner*—W. Stallard

*Attorney, Agent, or Firm*—Toren, McGeady and Stanger

[57] ABSTRACT

A molten steel, which may optionally contain boron to increase hardenability is poured into ingot molds, bloomed and primary hot worked to a mother tube of intermediate cross-section. Before being cooled down to below about 800° C, the mother tube is reheated to about 930° C, scale from the outside surface thereof is removed, and it is secondary hot worked to a pipe of final dimensions with a reduction, measured in terms of equivalent strain as expressed by the following formula, of not less than $\bar{\epsilon} = 0.02$ for the removal of scale from the inside surface of the pipe. It is then directly quenched to produce a finished seamless steel pipe having far better shape at a higher heat efficiency than in the conventional process. Better toughness is effected when the degree of secondary hot work is not smaller than $\bar{\epsilon} = 0.20$.

$$\bar{\epsilon} = \sqrt{2/3}\,\sqrt{(\epsilon_1 - \epsilon_2)^2 + (\epsilon_2 - \epsilon_3)^2 + (\epsilon_3 - \epsilon_1)^2}$$

7 Claims, 12 Drawing Figures

X 200

X200

COMBINED MECHANICAL AND THERMAL PROCESSING METHOD FOR PRODUCTION OF SEAMLESS STEEL PIPE

BACKGROUND OF THE INVENTION

This invention relates to a mechanical and thermal processing method for production of seamless steel pipes having homogeneous martensitic structure with a combination of high strength and toughness and with minimized distortion, and more particularly to a process for producing such steel pipes at a high thermal efficiency.

In producing seamless steel pipes of high quality with respect to strength and toughness, it has been the prior art practice to carry out either or both of the adjustment of the alloying elements of the steel itself and the heat treatment of the steel pipe of final gage in a manner to control within predetermined limits, the final properties of the steel pipe. Where the heat treatment is employed to control the final properties, the resultant conventional process for producing steel pipes is characterized by the separate and independent application of the forming and heat treating steps. In other words, the pipe forming operation is not correlated to the heat-treating operation involving the quenching and tempering. This permits the use of a heat-treating apparatus as arranged independently of the pipe producing apparatus so that the steel pipe in the as-formed condition is cooled down to room temperature before the application of the heat treatment thereto.

Such an independently operating mechanical and thermal processing method for improving quality characteristics of steel pipes has various disadvantages. One of these is that the heat energy retained in the steel pipe at the forming step is lost with no effect on the heat treating step as the steel pipe is cooled during the time period intervening the forming and heat treating steps. Another disadvantage is biased on the remarkable reduction of the productivity of steel pipes due to the interruption of a production run thereof at a point between the forming and heat treating steps. Still another disadvantage is that the heat treatment requires an additional amount of heat energy as the steel pipe is reheated from room temperature to and maintained at a temperature at which the heat treatment is performed. This in turn calls for a further increase in the amount of scale produced on the steel pipe surfaces during an elongated cooling time after the pipe-forming operation.

Such scale adhered to the pipe surfaces leads to the reduction of the cooling rate in the quenching step with the resulting slack quenching, which is the main factor in giving rise to increasing the degree of distortion of te quenched pipe.

SUMMARY OF THE INVENTION

The present invention has as its general object to overcome the above-mentioned conventional drawbacks and to provide a combined mechanical and thermal processing method for production of seamless steel pipes having a homogeneous martensitic structure with excellent strength and toughness and with minimized distortion at a high thermal efficiency compared with the prior art. This has been accomplished by the following findings: The heat energy of the steel pipe resulted from the hot working operation can be utilized as a part of the heat energy necessary for the steel pipe to be austenitized. After a hollow billet or bloom is hot rolled to an intermediate gate, de-scaling is performed at the outside surface of the steel pipe to an extent sufficient to assist in uniform cooling of the steel pipe when quenched. The subsequent diameter reducing operation causes sufficient removal of scale from the inside surface of the steel pipe provided that the reduction, measured in terms of equivalent strain ($\bar{\epsilon}$) as defined by the following formula, is more than 0.02.

$$\bar{\epsilon} = (\sqrt{2/3})\sqrt{(\epsilon_1 - \epsilon_2)^2 + (\epsilon_2 - \epsilon_3)^2 + (\epsilon_3 - \epsilon_1)^2}$$

wherein $\epsilon_1 = ln(l_2/l_1)$ $\epsilon_2 = ln(t_2/t_1)$ $\epsilon_3 = ln[(2r_2 - t_2)/(2r_1 - t_1)]$ wherein $l$, $t$ and $r$ are the length, thickness and radius of the steel pipe respectively, and the subscripts 1 and 2 mean before and after the diameter reducing operation respectively. When a reduction of more than $\bar{\epsilon} = 0.20$ combined with specified thermal processing conditions, austenite grain refining can be achieved to improve the toughness of the steel. The hardenability of the steel can be controlled by the addition of boron provided that specified thermal processing conditions are employed before the quenching.

DETAILED DESCRIPTION OF THE INVENTION

The present invention will next be explained as applied to a process for producing a seamless steel pipe comprising the steps of adjusting the chemical composition of the steel at the melting stage of the steel, pouring the molten steel into ingot molds from which are formed billets or blooms adapted to produce a finished steel pipe of desired dimensions, primary hot working the billet or bloom to a mother tube having an intermediate cross-sectional size, said primary hot working step including piercing, rolling and reeling operations, secondary hot working of the mother tube to final dimensions, and quenching the pipe, if necessary, followed by tempering.

According to one feature of the present invention, the mother tube from the primary hot working step is maintained at a temperature for a period of time long enough to secure a uniform distribution of the temperature throughout the entire pipe, and then in order to remove scale from the outside surface of the mother tube, put in the austenitic state just before the secondary hot working step is carried out.

Figure 1:
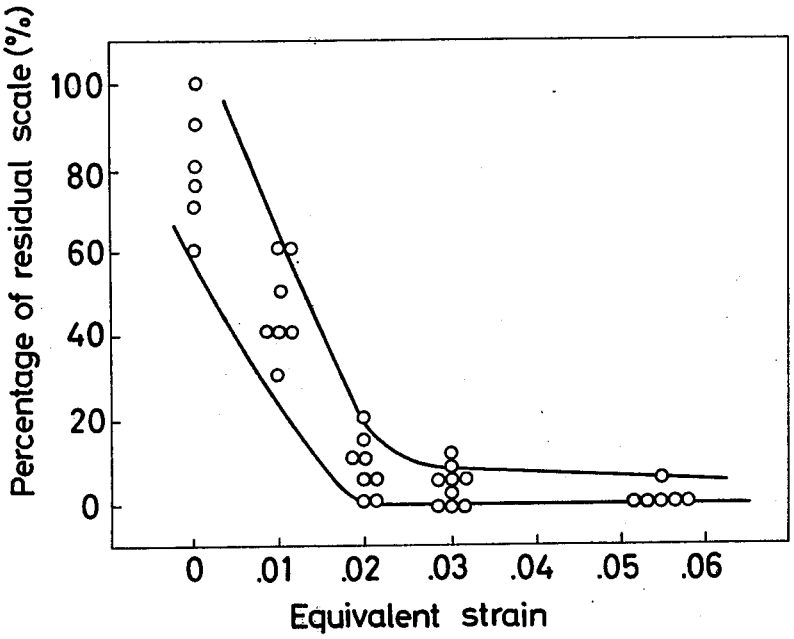
FIG. 1 is a graph showing the dependence of the percentage of scale remaining adhered to the inside surface of a steel pipe on the equivalent strain ($\bar{\epsilon}$) after the secondary hot working step is completed.

As soon as the descaling step has been completed, without giving an opportunity of causing formation of new scale on the outside surface of the mother tube, the secondary hot working step is applied to the mother tube with a reduction, measured in terms of equivalent strain ($\bar{\epsilon}$), of more than 0.02, whereby almost all the scale is removed from the inside surface of the pipe as can be seen from FIG. 1. It is assumed that such a diameter reduction causes the generation of heat in a quantity large enough to recover the temperature drop in the vicinity of the outside surface of the raw pipe resulting from the descaling operation so that the temperature distribution is made uniform in the radial direction of the pipe. As the outside and inside surfaces of the pipe are rid of scale and caused to have equal temperatures to each other, the steel pipe is quenched from a temperature higher than the $Ar_3$ point for the steel to obtain a finished steel pipe.

In order to prevent introduction to the quenched pipe of undesirable deformation and particularly distortion along the length thereof, it is essential to control within predetermined limits, the cooling rate of the pipe when the heated pipe is immersed into a quenching medium. This control can be effected with sufficient accuracy only when the pipe to be quenched is free from scale and when the cooling begins from the uniformarized temperature distribution state of the pipe.

Accordingly, another feature of the present invention is that the mechanical processing of the pipe in the hot state is associated with the subsequent thermal processing involving the quenching operation so that the pipe may be subjected to the quenching before the temperature of the pipe reaches below the critical temperature level. This leads to the assurance of the scale-free surfaces of the pipe to be quenched and of the uniform temperature distribution in the radial direction of the pipe. It is thereby made possible to impart into the quenched steel, a homogeneous microstructure with limitation of distortion to a very small degree.

Still another feature of the present invention is that the secondary hot working step is carried out with a reduction of more than $\bar{\epsilon} = 0.20$ to refine the austenite grains to improve the toughness of the pipe.

It is known that the toughness of a steel material depends upon the microstructure of the metal, and the amount, type and number of alloying elements added as well as upon the size of the austenitic grains. In the case of seamless steel pipes, the primary hot working step begins with the piercing of billets or blooms heated to as high a temperature as 1200° C. This heating causes growth of the austenitic grains to a large extent, and the grown austenitic grains remains unchanged in size during the primary hot working operation because the treating temperature is so high. According to the present invention, however, it is made possible that as the secondary hot working step is carried out at a relatively low temperature, namely, normally below 950° C and preferably below 900° C, the size of the austenitic grains is decreased to a desired level depending upon the resultant equivalent strain provided that the reduction is larger than $\bar{\epsilon} = 0.20$ as can be seen from FIG. 3. It is to be noted that this degree of hot working is far larger than that necessary to effect sufficient descaling from the inside surface of the pipe, i.e. $\bar{\epsilon} = 0.02$.

A further features of the invention is to take advantage of utilizing the heat energy of the hot worked pipe in carrying out the quenching operation to thereby save an additional amount of heat energy which would be otherwise necessary to increase the temperature of the pipe to be quenched as the pipe from the secondary hot working step is cooled down to room temperature.

As far as is known, the direct quenching method which is characterized by a remarkable economy in heat energy cost has been brought into practice with the production of thick plates, but not with the production of pipes. This is because pipes are very susceptible to distortion when quenched as compared with plates, and because this problem has thus far been considered very difficult to solve on the industrial scale. As stated above, however, the present invention has established the practical utilization of the direct quenching method in producing seamless steel pipes by the sequence of the descaling step and the secondary hot working step with a specified pipe diameter reduction.

The basic equipment for performing the primary hot working step consists generally of three pieces of equipment, namely, a piercing machine, a roll stand and a reeling machine, if necessary, followed by a sizing mill, these pieces of equipment being arranged along the same production line of pipes, while the basic equipment for producing pipes of final dimensions from the mother tubes supplied from the primary hot working step consists of only a single piece of equipment, such as, a sizing mill and a stretch reducing mill capable of working the mother tube with a controlled reduction of the pipe diameter as specified above.

So long as the primary hot working equipment is operated to provided mother tubes with a uniform temperature distribution at such a temperature level as to insure that the austenite structure of the mother tube is retained until the quenching operation is performed, the subsequent steps including the descaling and secondary hot working steps may be applied to the mother tubes without further heat treatment. If not so, that is, either when the actual temperature of the mother tubes is lower than the critical temperature level for the austenitic structure retention, or when the temperature distribution is not uniform, it is necessary to incorporate an additional step of either reheating or heat uniformalizing the mother tubes between the primary hot working step and the descaling step. In this additional step, the uniformalization of temperature distribution must be effected at a temperature level high enough to not only permit the secondary hot working operation, but also to retain the austenite structure in the steel until the quenching step is applied thereto. The basic equipment for achieving such uniformalization of temperature distribution may be comprised of a heating furnace of the conventional type using gas or liquid fuel.

At a very early stage in the process for producing seamless steel pipes, i.e. the melting stage of the steel by a steel-making furnace of the conventional type such as a converter and an electric furnace, the chemical composition of the steel is adjusted by taking into account the final properties of steel pipes, and a vacuum degassing operation may be carried out to facilitate refining before the molten steel is teemed to ingot casting, or continuous machine casting. Such castings are formed into billets or blooms of dimensions adapted for production of pipes of desired final dimensions. The preliminary determination of the chemistry is not essential to the present invention except for boron of which the function will be described in detail later, but it is preferred to operate the present invention with carbon steels, low carbon steels, or low alloy steels, whose chemistry by weight comes within the following:

Table 1

| | Percent | | Percent |
|---|---|---|---|
| Carbon | up to 0.5 | preferably | 0.05 - 0.30 |
| Silicon | up to 1.0 | preferably | 0.01 - 0.40 |
| Manganese | up to 3.0 | preferably | 0.8 - 1.5 |

Considering the required strength, toughness, corrosion resistance, etc., one or more of the following elements may be added.

| | |
|---|---|
| Chromium | 0.01 - 5.0 |
| Nickel | 0.01 - 2.0 |
| Copper | 0.01 - 1.0 |
| Molybdenum | 0.01 - 2.0 |
| Aluminum | up to 0.1 |
| Vanadium | up to 0.5 |
| Titanium | up to 0.5 |
| Zirconium | up to 0.5 |
| Niobium | up to 0.5 |
| Boron | 0.0003 - 0.0050 |
| Iron | Balance, except for the unavoidable impurities |

Of these alloying elements, it has now been found that boron is particularly effective in increasing the hardenability of steels provided that specified thermal processing conditions to be described later are satisfied. In this case, it is preferred to add a nitride-formable element, such as, titanium along with boron to avoid the loss of effective boron by reaction with nitrogen. For the purpose of deoxidation, desulfurization, improvement of toughness in C direction, and the like, Ca, REM and other additives may be added to the steel composition.

In order to impart a combination of high strength and high toughness to the finished seamless steel pipes, it is required that, though the primary hot working step may be carried out under the conditions known in the art, the temperature of the mother tube before the entrance to the temperature distribution uniformalizing step must be either higher than the $Ar_3$ point for the steel, or lower than the $Ar_1$ point for the steel, and the degree of hot work effected in the secondary hot working step must be controlled in accordance with the final properties of steel pipes. Now assuming that the mother tube prior to the temperature distribution uniformalizing step has a two-phase structure ($\alpha + \gamma$), when the mother tube is reheated to a temperature higher than the $Ar_3$ point at which the temperature distribution is uniformalized, the steel is entirely austenitized with the resulting structure being comprised of coarse austenite grains which was present prior to the reheating operation and fine austenite grains produced by the reheating operation as $\alpha$ is transformed to $\gamma$. When the secondary hot working step is applied to such a mixture of grains of largely different size, the working effect tends to be concentrated in the fine grains so that a uniform grain refinement can not be obtained. Also, the grain mixture irregularity becomes more apparent and thus it is more difficult to impart sufficient hardenability to the fine structure when the quenching step is applied to the steel, resulting in ununiformity of the hardness of the steel. Even when the hardenability of the steel pipe is so sufficient that the fine austenitic structure is hardened to almost the same extent as that to which the coarse austenitic structure is hardened, it is proven that the quality characteristics of the steel having mixed fine and coarse grain structures are unstable and vary from sample to sample.

It is, however, of importance to note that the thermal processing conditions described in the paragraphs above are confined for the purpose to insure a high standard of strength and toughness of the steel pipe, but are not essential for the purpose of improving the distortion of the quenched steel pipe. If the finished steel pipe is expected not to have high quality characteristics but only to have minimized distortion, it is not always necessary to take into account the above mentioned conditions.

Consideration is next given to the case where the temperature of the mother tube is limited to not higher than the $Ar_1$ point for the steel before the pipe is treated by the reheating furnance in the temperature distribution uniformalizing step.

To improve the characteristics of steel pipes such as strength, toughness, sulfide corrosion cracking resistance and the like, it is desirable to decrease the austenite grain size. This can be achieved by applying a specified degree of work to the mother tube in the secondary hot working step. As the degree of work cannot be increased without limitation because of a final gage of the steel pipe, there is a limitation to the amount of decrease of the grain size which is permissible in the secondary hot working step. If it is desired to effect decrease in the grain size in addition to that permissible in the secondary hot working step, an alternate provision must be made. An example of such a provision is to lower the temperature of the mother tube to not more than the $Ar_1$ point prior to the application of the reheating step, and then to heat the mother tube to a temperature higher than the $Ar_3$ point.

When the mother tube from the primary hot working step is cooled to a temperature below the $Ar_1$ point, the structure produced in the mother tube is entirely of the $\alpha$ phase. Next when the mother tube is heated to a temperature above the $Ar_3$ point, a fine austenite structure can be obtained independently of the coarse austenite grains which were present at a time when the primary hot working step was applied. These fine austenite grains are decreased in size when the mother tube is hot worked with a diameter reduction of more than $\bar{\epsilon} = 0.20$. After the commpletion of the secondary hot working step, the obtained steel pipes of final dimensions are quenched, whereby the fine austenite structure is transformed to a fine martensitic structure which when tempered from a temperature below the $Ac_1$ point for the steel provided a seamless steel pipe having improved toughness.

In this process including the step of decreasing the temperature of the mother tube to lower than the $Ar_1$ point before it is inserted into the reheating furnace, it is possible to utilize precipitation of carbide and/or nitride aside from the transformation of $\alpha$ to $\gamma$ in decreasing the grain size. When carbide and/or nitride formable elements such as Al, Nb and V are added to the steel for the purpose of decreasing the grain size, these alloying elements are solutionized in the austenite as the billet or bloom is heated to a high temperature before the primary hot working step is carried out. In so far as the steel is in the form of billets or blooms, therefore, these alloying elements do not affect the austenite grain size. In addition thereto, as the austenite grains are caused to grow by the billet forming operation, almost no decrease of the grain size occurs when the primary hot working step is applied to the billet. Once an opportunity is given to a decrease of the temperature of the mother tube below the $Ar_3$ point after the completion of the primary hot working step, the above-mentioned alloying elements are precipitated as carbide-nitride in the $\alpha$ phases, and, in the subsequent reheating step, these precipitates act advantageously on the formation of austenitic nuclei and on the inhibition of grain growth so that a fine austenitic structure can be obtained.

By taking into account the fact that the temperature at which the precipitation of carbide-nitride in the $\alpha$ phases occurs is generally higher than 500° C, it is desirable from the standpoint of effective utilization of heat energy to operate this process in such a manner that the temperature to which the mother tube is cooled after the primary working step but before the reheating step is not lower than 500° C. It will be appreciated that the above-described process is suitable for production of those of the steel pipes which are required to have toughness at low temperature, for example, line pipes.

Figure 3:
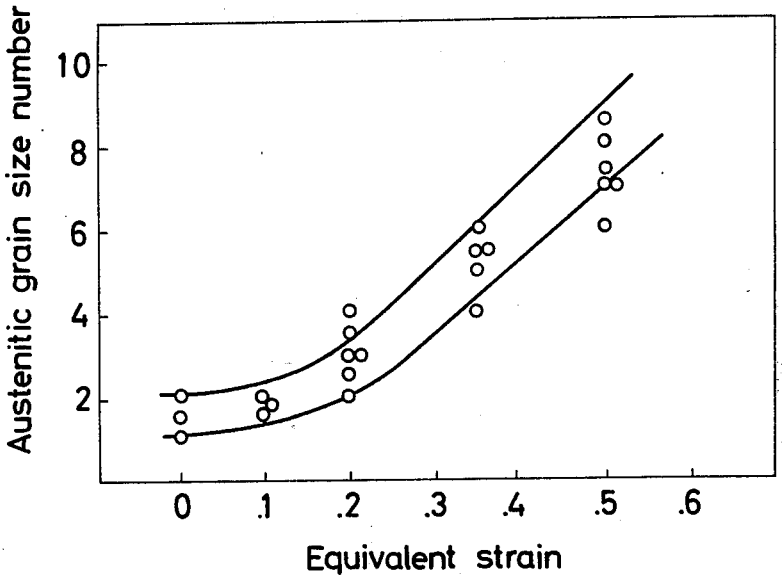
FIG. 3 is a graph showing the variation of the size of austenite grains on the ASTM scale as function of equivalent strain ($\bar{\epsilon}$).
Figure 2:
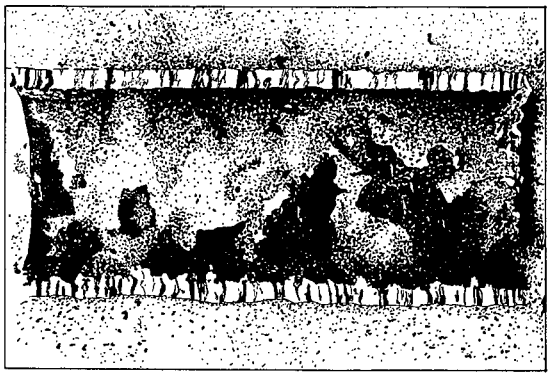
FIG. 2 is a photograph showing the removing state of scale from the inside surface of a steel pipe when subjected to the secondary hot working step.

Next, how much degree of work is to be applied to the mother tube in the secondary hot working step will be described by reference to FIGS. 1, 2 and 3. In general, the degree of two-dimensional work, as in rolling steel sheets, can be defined by a function of a single variable, namely, either sheet thickness, or sheet length. In the case of pipes, however, the work is three-dimensional, as the diameter, thickness and length of the pipe are simultaneously varied in the usual rolling process. For this reason, the degree of work which is applied to the mother tube can not be uniquely defined by the amount of dimensional variation in only one direction, but it is convenient to define it in terms of equivalent strain ($\bar{\epsilon}$) as mentioned above.

FIG. 1 shows the relationship between the amount of equivalent strain applied to the mother tube in the secondary hot working step and the percentage of residual scale left on the inside surface of the resultant pipe as measured after the quenching step is applied thereto. By the term "percentage of residual scale" herein used, it is meant that non-intimately adherent scale, which is undesirable for the quenching because of air included between the scale and the steel surface, is left behind on the inside surface of the quenched pipe at that percentage of surface area based on the entire inside surface area thereof, as measured by observation with naked eyes from the cut-in-half pipe. As an example of evaluation for such amount, there is provided a FIG. 2 photograph for 40% of residual scale left on the inside surface of the quenched pipe. It is evidenced from FIG. 1 that the percentage of residual scale is decreased with increase in equivalent strain, reaching a minimum of 0 to 10% at an equivalent strain of 0.02.

When the pipe to be quenched has non-intimately adherent scale fragments distributed at random on the inside surfaces thereof, it is impossible to make the cooling rate uniform during the quenching operation and to also in impart uniform microstructure to the quenched pipe, causing an increase in the degree of distortion of the quenched pipe. To accomplish that object of the invention which is to improve the shape of the finished pipe, it is required to operate the secondary hot working step with a reduction of not less than $\bar{\epsilon} = 0.02$.

If refinement of the grain size is to be effected by the secondary hot working, such a small degree of work is not enough. As shown in FIG. 3, wherein an appreciable decrease in the grain size begins at an equivalent strain of 0.20. The data of FIG. 3 are obtained using a steel specimen No. 3 listed in Table 1 after the thermal processing of FIG. 9 with $Tc > Ar_3$ followed by the mechanical processing of Table 2 wherein w2 indicates the secondary hot working step for which the degree of work of FIG. 3 is measured in terms of equivalent strain.

Consideration will now be given to the chemical composition of the steel particularly with respect to the effect of boron. The steel pipe having a homogeneous martensitic structure over the entire length of thickness is characterized by high resistance against sulfide corrosion cracking. The larger the hardness of the martensite, the lower the corrosion cracking resistance. On this account, it is preferred that the chemistry range of carbon in the steel is as low as possible. Another advantageous aspect of low carbon steels is their use in production of line pipes which are required to have a high weldability. on the other hand, the lower the carbon content, the lower the hardenability. It has, however, now been found that the loss of hardenability caused by decreasing carbon content can be recovered by the addition of boron to the steel.

Boron is the element capable, unlike other alloying elements, of not producing the effect on hardenability when it is added to the steel without particular conditioning, but only when a conditioning is made to cause the occurrence of segregation of boron at the austenite grain boundaries of the steel to be quenched so that ferrite-bainite transformation is retarded. In other words, it is of importance to apply to the steel which is formulated to contain a certain amount of boron for the purpose of improving the hardenability, a heat treatment such that the boron is caused to segregate at the grain boundaries.

When the boron-containing steel is heated to a temperature highr than 1100° C to be austenitized, the boron solutionized in the steel matrix at the high temperature tends upon subsequent cooling and rolling operation to precipitate as boron compounds at the grain boundaries. This tendency becomes serious when the boron content exceeds 0.0010%. When the quenching step is applied to the steel having boron compound precipitates left unchanged at the grain boundaries, these precipitates serve as nuclei for promotion of the transformation to ferrite and bainite with the result that the hardenability is lowered. For this reason, the effect of boron on hardenability cannot be expected from the process employing the conventional direct quenching method wherein the steel once heated to a high temperature above 1100° C is rolled and then quenched. If good results of boron addition are to be effected, it is required that the boron compound precpitated at the grain boundaries be made removed either during the rolling operation or during the subsequent cooling step before quenching.

Figure 5:
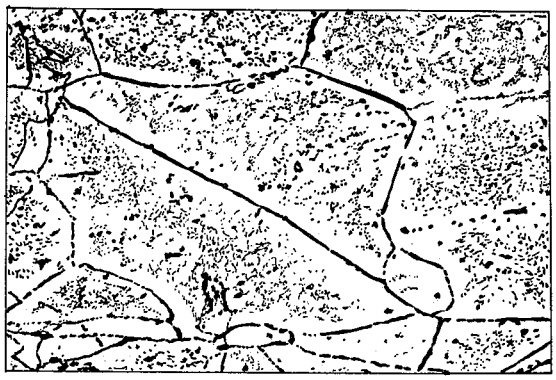
FIG. 5 is an autoradiograph showing the precpitation of boron compound at the austenite grain boundaries.
Figure 6:
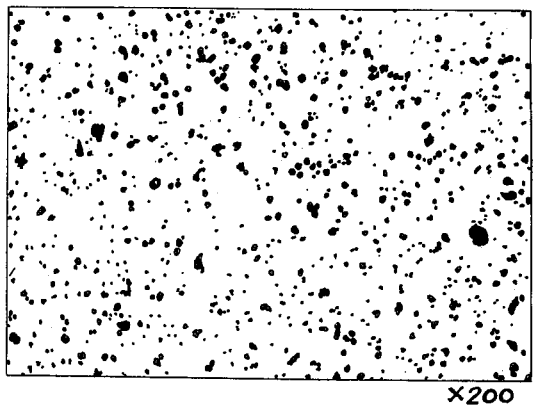
FIG. 6 is an autoradiograph showing the precipitation of boron compound within the matrix.
Figure 4:
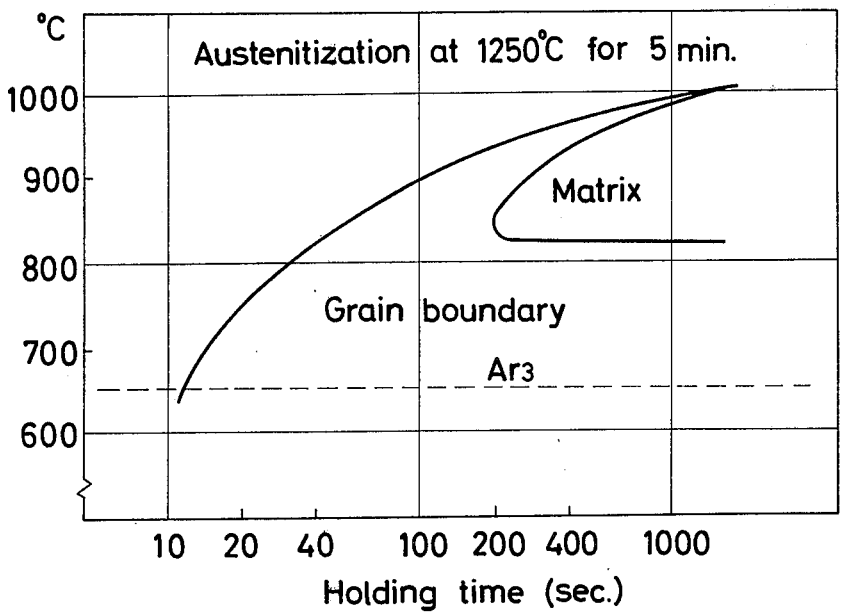
FIG. 4 is a graph showing the probabilities of finding boron compound precipitates either at the grain boundaries or in the matrix for a steel specimen No. 10 of Table 1 austenized at 1250° C by 5 minutes' heating.

The present inventors have conducted experiments using autoradiography to investigate the behavior of boron for segregation and precipitation in the steel as it is cooled after being heated to the high temperature, and have found that the boron compound precipitates are formed with cooling not only at the grain boundaries but also in the matrix. Further more detailed experiments using a steel containing 0.10%C, 0.26%Si, 1.35%Mn, 0.30%Cr, 0.11%Mo, 0.3%Ni, 0.042%Al, 0.0048%N and 0.0010%B indicate that, as shown in FIG. 4, the boron compound precipitates are more stable within the matrix than at the grain boundaries when the temperature falls in a range of 820° to 1100° C, and even if some of the boron compounds are caused to precipitate at the austenitic grain boundaries, they can be solutionized by holding the steel at a temperature within this range for a length of time longer than 3 minutes, and then caused to precipitate again within the matrix. FIGS. 5 and 6 show the occurrence of precipitation of the boron compounds at the grain boundaries and within the matrix respectively. Another finding is that the removal of the grain boundary precipitates leads to the recovery of the effect of boron on hardenability as the boron is caused to segregate at the austenite grain boundaries from the matrix by the cooling which is to be followed by the quenching. Based on these findings, we have set forth the necessary conditions for insurence of the boron effect in a process employing the direct quenching method such that the mother tube from the primary hot working step must be heated to and maintained at a temperature between 820° and 1100° C for a time period longer than 3 minutes. The upper limit of a permissible range of heating time is 60 minutes and preferably 30 minutes. When this upper limit is is exceeded, an increased amount of scale is formed on the surfaces of the mother tube to introduce descaling difficulties to the subsequent steps. Upon heating to a temperature higher than 1100° C, almost all the boron compounds are dissolved in the austenite. In this case, however, as mentioned above, the once dissolved boron will tend to precipitate at the austenite grain boundaries in the stage of the secondary hot working. For this reason, it is required to operate the temperature distribution uniformalizing step at a temperature not exceeding 1100° C. The result of this heat treatment is independent of whether the mother tube is heated to this range down from a temperature higher than 1100° C, or up from a temperature lower than 820° C, for example, the $Ar_1$ point.

The nitrogen content in the steel constitutes another factor in reducing the boron effect. This problem becomes serious when the nitrogen content is high, because there is some possibility of the occurrence of precipitation of the boron compounds at the grain boundaries during the step between the abovementioned reheating step and the quenching step. In order to avoid this situation, it is effective to add a nitride-formable element such as Ti and Zr at the melting stage of the steel. Ti and Zr may be added singly or in combination, and it is preferred to adjust the amount of Ti and/or Zr added as follows:

$$Ti\ (\%) \geqq 3.4\ (N(\%) - 0.002)$$

$$Zr\ (\%) \geqq 6.5\ (N(\%) - 0.002)$$

Where the effect of boron is utilized, according to the invention, the adjustment of the chemistry ranges of boron, titanium zirconium and other alloying elements is controlled by the foregoing formula and to the respective values of Table 1 shown above, then the steel is primary hot worked, reheated, descaled and secondary hot worked.

The seamless steel pipe of final dimensions supplied from the secondary hot working step is subsequently put into a cooling apparatus in which the quenching step is applied to the pipe. In order to minimize the temperature drop and the formation of scale which will occur during the time interval between the secondary hot working step and the quenching step, it is preferred to arrange the secondary hot working apparatus and the cooling apparatus on the same production line of pipes. As examples of the cooling type of apparatus, preferable use is made of the immersion type having a water pool or with forced agitation nozzles and the spray type having a number of nozzles arranged to surround the pipe. To assist improving the distortion of the finished pipe, it is preferred to employ the immersion type cooling apparatus. As the quenching medium, preferable use is made of water or a mixture of water and steam.

For the purpose of controlling the final strength in combination with the final toughness, a tempering step may be employed. When the main aim is laid on high toughness, it is preferred to operate the tempering step at a temperature between 500° C and the $Ac_1$ for the steel. The heating may be made using any type of heating apparatus such as induction heating and electric heating.

Figure 12:
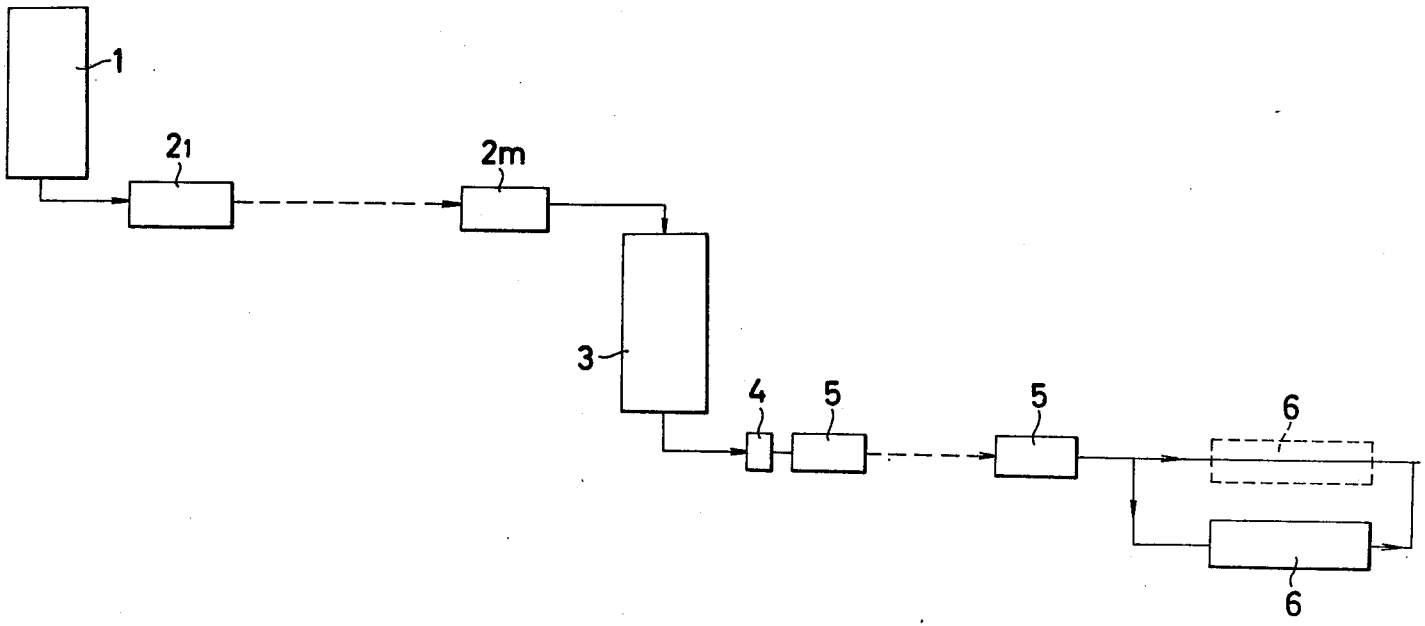
FIG. 12 illustrates one embodiment of the working and heat treating line used in the present invention.

One embodiment of the working and heat treating line used in the present invention will be described referring to FIG. 12.

1 is a heating furnace for heating a steel slab, $2_1 - 2_n$ is a primary hot working machine for rolling the steel slab heated to its working temperature by the heating furnace to a mother tube of intermediate dimension.

3 is a reheating furnace for heating and soaking the mother tube worked by the primary working machine to a complete austenitization.

4 is a descaling device for descaling the scale sticking to the surface of the mother tube extracted from the reheating furnace.

5 is a secondary rolling mill for working the mother tube descaled by the descaling device.

6 is a cooling device for quenching the steel pipe worked by the secondary rolling mill, and is arranged on the same line as the secondary rolling mill.

The invention will be further illustrated but is not intended to be limited by the following examples.

EXAMPLE 1

Figure 7:
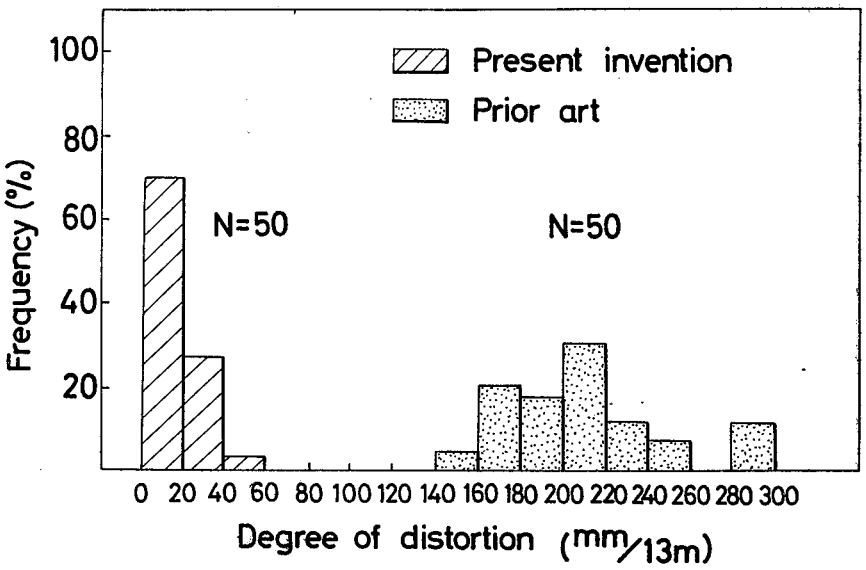
FIG. 7 is a graph showing the distribution of the finished steel pipes of steel specimen No. 1 with respect to the degree of distortion according to the present invention in comparison with the prior art.
Figure 8:
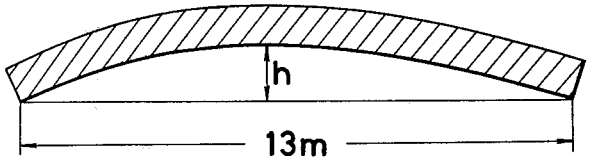
FIG. 8 is a diagram of geometry considered to define the degree of distortion ($h$) of a steel pipe as used in FIG. 7.

A steel was made containing 0.11%C, 0.23%Si, 0.81%Mn, 0.82%Cr, 0.37%Mo, 0.065%Al, 0.0058N and 0.0010%B. In the invention, the mother tube having an austenitic structure was put into a reheating furnace, then descaled, then secondary hot worked with a diameter reduction of $\bar{\epsilon} = 0.022$, and then directly quenched to obtain a seamless steel pipe having an outer diameter of 114.3mm with a thickness of 13mm and a length of 13m. The degrees of distortion of 50 finished pipes were measured in a manner shown in FIG. 8, and the results are shown in FIG. 7. According to the prior art, the mother tube after secondary hot worked was cooled in air to room temperature, then heated by a gas combusion type heating furnace adapted for te quenching operation (temperature: 920° C; the holding time: 15 minutes), and then quenched. The results are also shown in FIG. 7. It is evidenced from FIG. 7 that the distortion of the finished pipe of the invention is remarkably improved over the prior art.

As no essential relation is between the tendency of the steel to distortion and the chemistry of the steel, it will be appreciated that the effectiveness of the invention does not diminished by the selection of different type steels.

EXAMPLE 2

Five steel specimens were made whose chemical compositions are shown in Table 2 below.

Table 2

| Specimen No. | Composition | | | | | | | | | |
|---|---|---|---|---|---|---|---|---|---|---|
| | C | Si | Mn | Cr | Mo | Al | N | Ti | B | Nb |
| 1 | 0.15 | 0.26 | 1.35 | — | — | 0.030 | 0.0051 | 0.022 | 0.0015 | |
| 2 | 0.22 | 0.24 | 1.20 | — | — | 0.041 | 0.0048 | 0.015 | 0.0018 | |
| 3 | 0.27 | 0.25 | 1.19 | — | — | 0.028 | 0.0061 | 0.021 | 0.0016 | |
| 4 | 0.14 | 0.22 | 0.75 | 0.62 | 0.18 | 0.023 | 0.0041 | — | — | |
| 5 | 0.11 | 0.28 | 1.32 | — | — | 0.036 | 0.0020 | — | 0.0015 | 0.038 |

Figure 9:
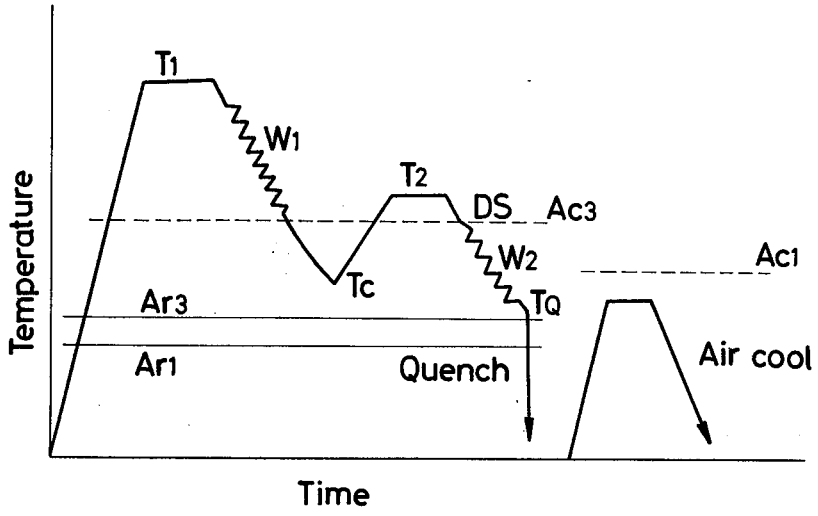
FIG. 9 is a diagram showing the variation with time of the temperature of the steel in producing a seamless steel pipe by employing the method of the present invention.
Figure 10:
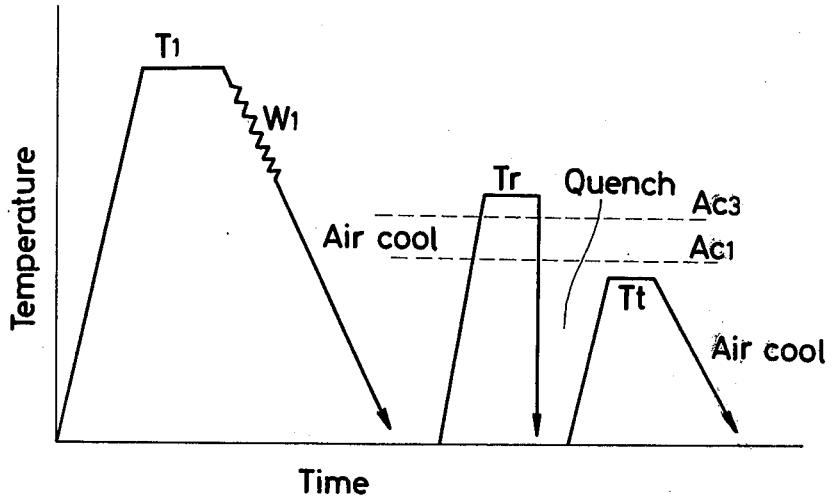
FIG. 10 is a similar diagram according to the prior art.

These steels were formed into blooms which were processed in a manner shown in the appended claims to produce seamless pipes having either a high tensile strength of a combination of high strength and high toughness with minimized distortion. This process is schematically illustrated in FIG. 9. A prior art process was carried out as schematically illustrated in FIG. 10 to contrast the present invention.

In the process of the invention, each of the blooms of different chemical composition was heated to a temperature ($T_1$) of 1250° C, then primary hot worked at a stage ($W_1$) wherein piercing, rolling, reeling and sizing operations were successively carried out, with the resultant temperature (Tc) of the mother tube just before the entrance to the reheating furnace being shown in Table 3, then reheated to a temperature ($T_2$) of 930° C for 15 minutes, then descaled at a stage (DS) using high pressure water, then secondary hot worked at a stage ($W_2$) with respective diameter reduction of either more than $\bar{\epsilon} = 0.02$, or more than $\bar{\epsilon} = 0.20$, then quenched from a temperature ($T_Q$) of 860° C, and then tempered at a temperature (Tt) of 600° C for 30 minutes. The results are shown in Table 3 below.

Table 3

| Steel specimen No. | Processing condition Tc(° C) | $\epsilon$ | Mechanical property: Tensile strength $\sigma_B$(Kg/mm²) | Toughness vTrs(° C) | Degree of distortion (mm/13m) |
|---|---|---|---|---|---|
| 1 | 810* | 0.03 | 73.2 | −40 | 24 |
| " | 805* | 0.24 | 74.0 | −60 | 18 |
| 2 | 803* | 0.03 | 80.1 | −35 | 45 |
| " | 807* | 0.24 | 81.5 | −50 | 30 |
| " | 810* | 0.35 | 80.5 | −60 | 38 |
| 3 | 812* | 0.03 | 84.4 | −35 | 21 |
| " | 810* | 0.26 | 84.2 | −50 | 18 |
| 4 | 810* | 0.03 | 75.4 | −50 | 40 |
| " | 640 | " | 76.0 | −80 | 58 |
| " | 505 | " | 76.0 | −80 | 30 |
| 5 | 820* | 0.03 | 72.0 | −80 | 26 |
| " | 638 | " | 72.0 | −120 | 18 |
| " | 490 | " | 73.0 | −120 | 40 |
| " | 490 | 0.26 | 72.5 | −140 | 18 |

*TC>$Ar_3$

In the prior art process, each of the blooms of different composition was heated to a temperature ($T_1$) of 1250° C, then primary hot worked in a manner similar to that shown in connection with the process of the invention, then allowed to stand in air so that the mother tube was cooled down to the room temperature, then reheated to a temperature (Tr) of 920° C for 15 minutes to effect austenitization, then quenched from a temperature ($T_Q$) of 860° C, and then tempered at a temperature (Tt) of 600° C for 30 minutes. The results are also shown in Table 4 below.

Table 4

| Steel specimen No. | Mechanical property: $\sigma_B$(Kg/mm²) | vTrs(° C) | Distortion of finished pipe (mm/13m) |
|---|---|---|---|
| 1 | 73.8 | − 70 | 205 |
| 2 | 81.5 | − 65 | 183 |
| 3 | 84.3 | − 65 | 180 |
| 4 | 76.0 | − 80 | 220 |
| 5 | 72.5 | −120 | 170 |

It is evidenced from Table 3 that when the degree of work in the secondary hot working step is more than $\bar{\epsilon} = 0.20$, the toughness of the finished pipe is improved, and further from Tables 3 and 4 in comparison with each other that the shape of the finished pipe of the invention is far improved over the prior art, while preserving as good a toughness as that of the prior art.

It is further evidenced from Table 3 that when the temperature (Tc) of the raw pipe before the reheating is lower than the $Ar_1$ point, increasing toughness results.

EXAMPLE 3

In order to investigate how the reheating temperature prior to the quenching operation affects the effect of boron on hardenability, experiments were made using three steels whose chemical compositions are shown in Table 5 below.

Table 5

| Specimen No. | Composition | | | | | | | |
|---|---|---|---|---|---|---|---|---|
| | C | Si | Mn | Cr | Al | N | Ti | B |
| 6 | 0.24 | 0.28 | 1.23 | 0.51 | 0.025 | 0.0062 | 0.020 | 0.0015 |
| 7 | 0.25 | 0.30 | 1.15 | 0.50 | 0.046 | 0.0067 | — | 0.0013 |

Table 5-continued

| Specimen No. | Composition | | | | | | | |
|---|---|---|---|---|---|---|---|---|
| | C | Si | Mn | Cr | Al | N | Ti | B |
| 8 | 0.23 | 0.25 | 1.21 | 0.48 | 0.041 | 0.0051 | — | — |

Figure 11:
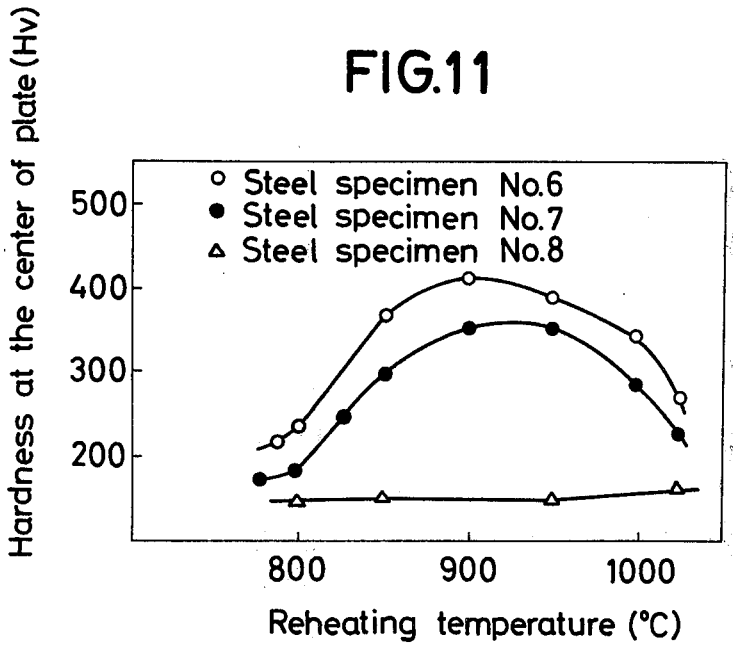
FIG. 11 is a graph showing the effectiveness of boron as a hardenability controllable element of the steel as a function of re-heat treating temperature just before the quenching operation.

These steels were formed into plates which were then heated to a temperature of 1150° C for 2 hours, then hot rolled to an intermediate gage of 50 millimeters, then reheated to a temperature ($T_2$) equal to that shown in Example 2 for 10 minutes, then hot rolled to a final gage of 30 millimeters, and then quenched from a temperature higher than 750° C. The results are shown in FIG. 11, wherein the abscissa is in the reheating temperature ($T_2$) and the ordinate is in the hardness of the quenched steel plate measured at the center of the thickness. It is evidenced from FIG. 11 that the boron-containing steels Nos. 6 and 7 are to produce high hardenability when they are reheated to a temperature between 820° and 1000° C.

As the boron effect is established only by the temperature history, the results obtained from the steel plates are valid for the steel pipes.

EXAMPLE 4

Using pipes each having a 16mm thickness 114.3mm diameter and 10m long, the advantage of the invention in saving the heat energy was evaluated as the pipes were processed in the manner of FIGS. 9 and 10. According to the prior art, the pipe must be heated from room temperature to 920° C to be austenitized before the quenching step is applied. On the other hand, according to the invention, the pipe is supplied in the as-heated condition from the primary hot working step and therefrom soon inserted to the reheating furnace, whereby the amount of heat energy which would be otherwise necessary for the pipe to be heated from room temperature to the temperature Tc of FIG. 9 can be saved. When this reheating temperature ($T_2$) was made equal to 920° C, that is, the austenitizing temperature of the prior art, and the temperature (Tc) was made equal to 800° C, the amount of heat energy saved was 40 to 60% in relation to the prior art.

What is claimed is:

1. A process for producing a seamless steel pipe comprising the steps of:

a. primary hot working a bloom into a mother tube with an intermediate cross-section comparatively nearer to that of the finished pipe product;

b. removing scale from the outside surface of said mother tube while being entirely austenitized;

c. secondary hot working said mother tube into a pipe of final dimensions with a degree of work applied thereto, measured in terms of equivalent strain ($\bar{\epsilon}$) as expressed by the following formula, of not less than $\bar{\epsilon} = 0.02$, $$\bar{\epsilon} = \sqrt{2/3}\,\sqrt{(\epsilon_1 - \epsilon_2)^2 + (\epsilon_2 - \epsilon_3)^2 + (\epsilon_3 - \epsilon_1)^2}$$

wherein $\epsilon_1 = ln(l_2/l_1)$ $\epsilon_2 = ln(t_2/t_1)$ $\epsilon_3 = ln[(2r_2 - t_2)/(2r_1 - t_1)]$ in which $l_1$, $t_1$ and $r_1$ are the length, thickness and radius of the mother tube respectively, and $l_2$, $t_2$ and $r_2$ are the length, thickness and radius of the pipe of final dimensions respectively; and d. directly quenching said pipe of final dimensions.

2. A process for producing a seamless steel pipe according to claim 1, further including a reheating step of reheating said mother tube after said primary hot working step, whereby the steel structure is made entirely austenitic.

3. A process for producing a seamless steel pipe according to claim 2, wherein said reheating step is operated at a temperature higher than the austenitizing temperature for the steel but lower than the austenitic grain growth occuring temperature for the steel.

4. A process for producing a seamless steel pipe comprising the steps of:

a. primary hot working a bloom into a mother tube of intermediate cross-section comparatively nearer to that of the finished pipe product;

b. removing scale from the outside surface of said mother tube while being entirely austenitized;

c. secondary hot working said mother tube into a pipe of final dimensions with a degree of work applied thereto, measured in terms of equivalent strain ($\bar{\epsilon}$) as expressed by the following formula, of not less than $\bar{\epsilon} = 0.02$.

$$\bar{\epsilon} = \sqrt{2/3)}\,\sqrt{(\epsilon_1 - \epsilon_2)^2 + (\epsilon_2 - \epsilon_3)^2 + (\epsilon_3 - \epsilon_1)^2}$$

wherein $\epsilon_1 = ln(l_2/l_1)$ $\epsilon_2 = ln(t_2/t_1)$ $\epsilon_3 = ln[(2r_2 - t_2)/(2r_1 - t_1)]$ in which $l_1$, $t_1$ and $r_1$ are the length, thickness and radius of the mother tube respectively, and $l_2$, $t_2$ and $r_2$ are the length, thickness and radius of the pipe of final dimensions respectively; and d. directly quenching said pipe of final dimensions; and e. tempering said quenched pipe below the $Ac_1$ transformation point for the steel.

5. A process for producing a seamless steel pipe according to claim 1, wherein said primary hot working step is terminated at a temperature not lower than the $Ar_3$ point for the steel, then followed by a step of holding said mother tube with uniform temperature distribution in the austenitic state, and wherein said quenching is done directly from a temperature not lower than the $Ar_3$ point.

6. A process for producing a seamless steel pipe according to claim 1, further comprising successive steps of cooling said mother tube to a temperature not higher than the $Ar_1$ point for the steel, and after said primary hot working cooling mother tube to a temperature higher than the $Ac_3$ point for the steel but not higher than the temperature at which the austenite grains in the surfaces of said mother tube begins to grow, and wherein said quenching is performed from a temperature not lower than the $Ar_3$ point.

7. A process for producing a seamless steel pipe according to claim 1, wherein said mother tube has a composition containing 0.003 to 0.0050% by weight of boron based on the total weight of the steel, and said primary hot working step is directly followed by a step of heating said mother tube at a temperature between 820° and 1100° C for a length of time longer than 3 minutes.

* * * * *